US006867360B2

(12) United States Patent
Takahashi et al.

(10) Patent No.: US 6,867,360 B2
(45) Date of Patent: Mar. 15, 2005

(54) ELECTRONIC MUSICAL INSTRUMENT, DIFFERENCE TONE OUTPUT APPARATUS, A PROGRAM AND A RECORDING MEDIUM

(75) Inventors: Kengo Takahashi, Hamamatsu (JP); Hiroyuki Tsuru, Nishinomiya (JP); Tetsu Kobayashi, Hamakita (JP); Katsuhiko Masuda, Fujieda (JP)

(73) Assignee: Yamaha Corporation (JP)

( * ) Notice: Subject to any disclaimer, the term of this patent is extended or adjusted under 35 U.S.C. 154(b) by 176 days.

(21) Appl. No.: 10/386,624

(22) Filed: Mar. 12, 2003

(65) Prior Publication Data

US 2003/0221543 A1 Dec. 4, 2003

(30) Foreign Application Priority Data

Mar. 14, 2002 (JP) ..... 2002-070628

(51) Int. Cl.[7] ..... G10H 1/10; G10H 7/00
(52) U.S. Cl. ..... 84/631; 84/664
(58) Field of Search ..... 84/630, 631, 664

(56) References Cited

U.S. PATENT DOCUMENTS 5,504,270 A * 4/1996 Sethares ..... 84/645
5,763,802 A * 6/1998 Aoki et al. ..... 84/613

FOREIGN PATENT DOCUMENTS

JP 2003-186463 A 7/2003

* cited by examiner

*Primary Examiner*—Jeffrey W Donels
(74) *Attorney, Agent, or Firm*—Rossi, Kimms & McDowel

(57) ABSTRACT

An electronic musical instrument according to the invention stores a difference tone identifying table which associates musical sounds of different pitches with a difference tone perceived from the musical sounds of different pitches. Receiving an instruction to simultaneously produce musical sounds of different pitches, the electronic musical instrument extracts a difference tone corresponding to the musical sounds of different pitches from the difference tone identifying table and generates then outputs a sound signal corresponding to the extracted difference tone and the musical sounds of different pitches.

11 Claims, 8 Drawing Sheets

T4

| | noteA | noteA | DIFFERENCE TONE | VOLUME FACTOR |
|---|---|---|---|---|
| PERFECT FIFTH | C2 | G2 | C1 | 1 |
| | ⋮ | ⋮ | ⋮ | ⋮ |
| | Cm | Gm | Cm-1 | 1 |
| | E2 | B2 | E1 | 1 |
| | ⋮ | ⋮ | ⋮ | ⋮ |
| | Em | Bm | Em-1 | 1 |
| | F2 | C3 | F1 | 1 |
| | ⋮ | ⋮ | ⋮ | ⋮ |
| | Fm-1 | Cm | Fm-2 | 1 |
| PERFECT FOURTH | G2 | C3 | C1 | 0.9 |
| | ⋮ | ⋮ | ⋮ | ⋮ |
| | Gm-1 | Cm | Cm-2 | 0.9 |
| | C3 | F3 | F1 | 0.9 |
| | ⋮ | ⋮ | ⋮ | ⋮ |
| | Cm | Fm | Fm-2 | 0.9 |
| | D3 | G3 | G1 | 0.9 |
| | ⋮ | ⋮ | ⋮ | ⋮ |
| | Dm | Gm | Gm-2 | 0.9 |
| | E3 | A3 | A1 | 0.9 |
| | ⋮ | ⋮ | ⋮ | ⋮ |
| | Em | Am | Am-2 | 0.9 |
| MAJOR THIRD | C3 | E3 | C1 | 0.8 |
| | ⋮ | ⋮ | ⋮ | ⋮ |
| | Cm | Em | Cm-2 | 0.8 |
| | ⋮ | ⋮ | ⋮ | ⋮ |
| | ⋮ | ⋮ | ⋮ | ⋮ |
| MINOR THIRD | E3 | G3 | C1 | 0.7 |
| | ⋮ | ⋮ | ⋮ | ⋮ |
| | Em | Gm | Cm-2 | 0.7 |

FIG. 2

T1

| KEY | 1 | 2 | 3 | ..... | 40 | 41 | ..... | m |
|---|---|---|---|---|---|---|---|---|
| FLAG | 0 | 0 | 1 | ..... | 1 | 1 | ..... | 0 |
| vel | | | v1 | ..... | v4 | v5 | ..... | |

FIG. 3

T2

| NOTE | KEY-SPECIFIED NOTE |
|---|---|
| note1 | C1 |
| note2 | G2 |
| note3 | F5 |
| note4 | F2 |
| note5 | D3 |
| note6 | C3 |
| note7 | G3 |
| ⋮ | ⋮ |
| ⋮ | ⋮ |

FIG. 4

T3

| note1 | note2 | DIFFERENCE TONE |
|---|---|---|
| C2 | G2 | C1 |
| F2 | C3 | F1 |
| D3 | G3 | G1 |
| ⋮ | ⋮ | ⋮ |
| ⋮ | ⋮ | ⋮ |

FIG. 5

T4

| | noteA | noteA | DIFFERENCE TONE | VOLUME FACTOR |
|---|---|---|---|---|
| PERFECT FIFTH | C2 | G2 | C1 | 1 |
| | ⋮ | ⋮ | ⋮ | ⋮ |
| | Cm | Gm | Cm-1 | 1 |
| | E2 | B2 | E1 | 1 |
| | ⋮ | ⋮ | ⋮ | ⋮ |
| | Em | Bm | Em-1 | 1 |
| | F2 | C3 | F1 | 1 |
| | ⋮ | ⋮ | ⋮ | ⋮ |
| | Fm-1 | Cm | Fm-2 | 1 |
| PERFECT FOURTH | G2 | C3 | C1 | 0.9 |
| | ⋮ | ⋮ | ⋮ | ⋮ |
| | Gm-1 | Cm | Cm-2 | 0.9 |
| | C3 | F3 | F1 | 0.9 |
| | ⋮ | ⋮ | ⋮ | ⋮ |
| | Cm | Fm | Fm-2 | 0.9 |
| | D3 | G3 | G1 | 0.9 |
| | ⋮ | ⋮ | ⋮ | ⋮ |
| | Dm | Gm | Gm-2 | 0.9 |
| | E3 | A3 | A1 | 0.9 |
| | ⋮ | ⋮ | ⋮ | ⋮ |
| | Em | Am | Am-2 | 0.9 |
| MAJOR THIRD | C3 | E3 | C1 | 0.8 |
| | ⋮ | ⋮ | ⋮ | ⋮ |
| | Cm | Em | Cm-2 | 0.8 |
| | ⋮ | ⋮ | ⋮ | ⋮ |
| | ⋮ | ⋮ | ⋮ | ⋮ |
| MINOR THIRD | E3 | G3 | C1 | 0.7 |
| | ⋮ | ⋮ | ⋮ | ⋮ |
| | Em | Gm | Cm-2 | 0.7 |

ELECTRONIC MUSICAL INSTRUMENT, DIFFERENCE TONE OUTPUT APPARATUS, A PROGRAM AND A RECORDING MEDIUM

BACKGROUND OF THE INVENTION

The present invention relates to an electronic musical instrument, difference tone output apparatus, a program and a recording medium and in particular to an electronic musical instrument for reproducing a performance sound of a musical instrument such as a pipe organ installed in a stone building, difference tone output apparatus for reproducing the performance sound, a program which describes the performance processing, and a recording medium which records the program.

In a recent dry construction hall where a pipe organ is installed, measures such as a highly rigid trim of a hall, optimized pipe arrangement, specific registration of an organ, and introduction of a sound field support system which electronically interpolates the reverberation time are taken in order to reproduce a performance sound with a long reverberation time same at that in a stone church in the Middle Ages of Europe.

The problem with the highly rigid trim of a hall and introduction of a sound field support system results in higher costs and optimization of pipe arrangement is sometimes difficult due to limitation on the structure of the musical instrument.

A stone building has a long reverberation time even in a low register, so that a difference tone is easy to perceive from a performance sound. Here, the difference tone is a tone perceived by the auditory system and is a derivative tone heard by generation of a vibration (f1–f2) corresponding to a difference between the vibrations from a distortion on the resonance in an auditory organ (nonlinearity of the basement membrane in cochlear duct) when one hears different vibration frequency f1 (Hz) and f2 (Hz) by the same ear. Thus, in a stone building, a sound lower than that of the musical instrument itself is perceived with a delay time, which sounds as a "rich bass tone".

However, according to the related art which reproduces a sound in a stone building in a dry construction hall, it is practically difficult to provide the interior of a building with the same sound characteristics as those of a stone building. Although it is possible to emphasize the bass tone through registration of an organ and a sound field support system, it is different from reinforcement using a difference tone so that an audience is not fully satisfied with the bass tone reproduced.

SUMMARY OF THE INVENTION

The invention has been proposed in order to solve the problems of the aforementioned related art and aims at providing an electronic musical instrument which can reproduce a performance sound with rich bass in a stone building, difference tone output apparatus, a program which describes the performance processing, and a recording medium which records the program.

In order to solve the problems, the invention provides an electronic musical instrument characterized in that the electronic musical instrument comprises a plurality of operating members for performance, a detector for detecting the operation of the operating members for performance, a signal generator for generating a sound signal of a musical sound assigned to each of the operating members for performance depending on the detection result of the detector, the signal generator generating a sound signal of musical sounds of different pitches and a musical sound equivalent to a difference tone perceived from the musical sounds of different pitches, in the case of generating a sound signal to simultaneously produce musical sounds of different pitches assigned to the operating members for performance, and an output unit for outputting a sound signal generated by the signal generator.

With this configuration, in the case of generating a sound signal to simultaneously produce musical sounds of different pitches assigned to the operating members for performance, it is possible to sound a difference tone previously perceived by the auditory system as included in a performance sound by generating a sound signal of musical sounds of different pitches and a musical sound equivalent to a difference tone perceived from the musical sounds of different pitches. In this way, a sound whose pitch is lower than the actual sound is sounded. It is thus possible to sound a performance sound with a rich bass such as one heard in a stone building.

The invention provides difference tone output apparatus characterized in that the apparatus comprises an input unit for inputting performance information to specify a musical sound, a signal generator for generating a sound signal based on the musical sound specified by the performance information, the signal generator generating a sound signal of musical sounds of different pitches and a musical sound equivalent to a difference tone perceived from the musical sounds of different pitches in case the performance information has instructed simultaneous production of the musical sounds of different pitches, and an output unit for outputting a sound signal generated by the signal generator.

With this configuration, by generating a sound signal of musical sounds of different pitches and a musical sound equivalent to a difference tone perceived from the musical sounds of different pitches in case the performance information has instructed simultaneous production of musical sounds of different pitches, it is possible to sound a difference tone previously perceived by the auditory system as included in a performance sound, thus sounding a performance sound with a rich bass such as one heard in a stone building, same as the foregoing configuration.

The invention provides difference tone output apparatus characterized in that the apparatus comprises a input unit for inputting performance information to specify a musical sound, a signal generator for generating a sound signal based on the musical sound specified by the performance information, the signal generator generating a sound signal of a musical sound equivalent to a difference tone perceived from musical sounds of different pitches in case the performance information has instructed simultaneous production of the musical sounds of different pitches, and an output unit for outputting a sound signal generated by the signal generator.

With this configuration, by generating a sound signal of a musical sound equivalent to a difference tone perceived from the musical sounds of different pitches in case the performance information has instructed simultaneous production of musical sounds of different pitches, it is possible to sound a difference tone previously perceived by the auditory system as included in a performance sound, thus sounding a performance sound with a rich bass such as one heard in a stone building, same as the foregoing configuration.

The invention provides a program for causing a computer comprising a plurality of operating members and detector for detecting the operation of the operating members to work as a signal generator for generating a sound signal based on the musical sound specified by the performance information, the signal generator generating a sound signal of musical sounds of different pitches and a musical sound equivalent to a difference tone perceived from the musical sounds of different pitches in case the performance information has instructed simultaneous production of the musical sounds of different pitches, and an output unit for outputting a sound signal generated by the signal generator.

With this configuration, in case a computer generates a sound signal to simultaneously produce musical sounds of different pitches assigned to the operating members by executing this program, it is possible to generate a sound signal of musical sounds of different pitches and a musical sound equivalent to a difference tone perceived from the musical sounds of different pitches. As a result, it is possible to sound a difference tone previously perceived by the auditory system as included in a performance sound, thus sounding a performance sound with a rich bass such as one heard in a stone building, same as the foregoing configuration.

The invention provides a program for causing a computer to work as a signal generator for generating a sound signal based on the musical sound specified by the performance information, the signal generator generating a sound signal corresponding to a musical sound equivalent to a difference tone perceived from the musical sounds of different pitches, in case the performance information has instructed simultaneous production of the musical sounds of different pitches, and an output unit for outputting a sound signal generated by the signal generator.

With this configuration, it is possible to generate a sound signal of a musical sound equivalent to a difference tone perceived from the musical sounds of different pitches in case the performance information has instructed simultaneous production of musical sounds of different pitches, when a computer executes this program. As a result, it is possible to sound a difference tone previously perceived by the auditory system as included in a performance sound, thus sounding a performance sound with a rich bass such as one heard in a stone building, same as the foregoing configuration.

The invention may be implemented by an aspect where the program is stored on computer-readable recording medium such as a CR-ROM, floppy disk or optical recording disk and delivered to general users or alternatively, the program is delivered on a network to general users.

BRIEF DESCRIPTION OF THE DRAWINGS

FIG. 2 shows a key event table;

FIG. 3 shows key-specified note producing table;

FIG. 4 shows a difference tone producing table;

FIG. 5 shows a difference tone identifying table;

DETAILED DESCRIPTION OF PREFERRED EMBODIMENTS

Embodiments of the invention will be described with reference to drawings. These embodiments describe the cases where the electronic musical instrument of the invention is applied to a pipe organ which sounds electronic sounds (hereinafter referred to as an electronic organ). Such embodiments are exemplary and are not intended to limit the invention but may be arbitrarily modified within the scope of the invention.

(1) First Embodiment

An electronic organ 1 according to the first embodiment aims at sounding a performance sound heard by an audience in a stone building, in a dry construction building or outdoors. In order to attain this object, the electronic organ 1 according to the first embodiment sounds the musical sound of an electronic sound corresponding to the keys on the electronic organ 1 on a one-to-one basis, as well as identifies difference tone preciously perceived by the auditory system when a plurality of musical sounds are simultaneously produced and sounds the difference tone at the same time.

In the following description, a musical sound directly specified by each key is represented as a "key-specified note" which is different from the musical sound of a difference tone heard when two key-specified notes are simultaneously sounded.

(1-1) Configuration of the Embodiment

Figure 1:
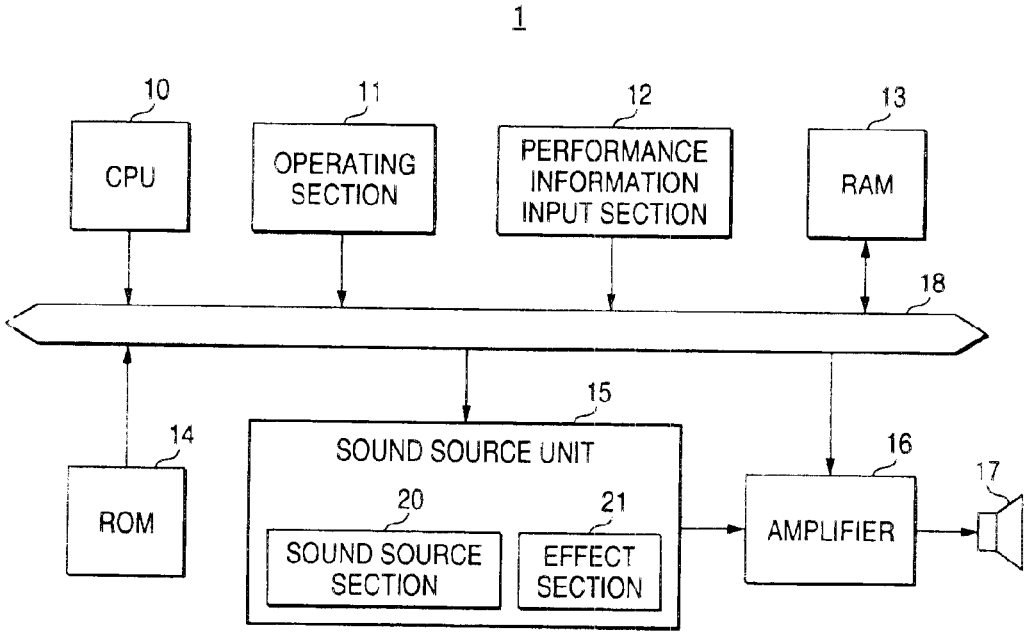
FIG. 1 is a block diagram of an electric configuration of the electronic organ according to an embodiment of the invention.

FIG. 1 is a block diagram of an electric configuration of the electronic organ 1. The electronic organ 1 includes a CPU 10, an operating section 11, a key-on detecting section 12, a RAM 13, a ROM 14, a sound source unit 15, an amplifier 16 and a speaker 17.

The CPU 10 exchanges various information with each section connected via a bus 18, that is, with the operating section 11, the key-on detecting section 12, the RAM 13, the ROM 14, the sound source unit 15, and the amplifier 16, and acts as a central control of the electronic organ 1. The operating section 11 informs the CPU 10 of the operation of an operation button such as a power switch (not shown).

The key-on detecting section 12 detects in a predetermined cycle the key-on and key-off events of m (M>2) keys (not shown) of the electronic organ 1. The key-on detecting section 12, detecting a key-on event, detects the velocity of the pressed key and informs the CPU 10 of the detection result.

In this embodiment, the CPU 10 supplies MIDI (Musical Instrument Digital Interface) data to the sound source unit 15 based on the detection result of the key-on detecting section 12 to issue a performance instruction to the sound source unit 15. The MIDI data includes a header track and a plurality of track blocks. In each track block is stored performance information such as performance events on the performance tracks and various events other than the performance information.

The RAM 13 is a memory which temporarily stores a key event table T1, a key-specified note producing table T2, a difference tone producing table T3, and the program data read by the CPU 10.

The key event table T1 is a table for storing the detection results of the key-on detecting section 12. For example, as shown in FIG. 2, the key event table T1 stores the key information (flag information) which indicates keys pressed by using data "1" and those not pressed by using data "0" and the velocity (vel) of each key pressed.

The key-specified note producing table T2 is a table for storing the musical sound name (note number) of a key-specified note where a note-on event is output, that is, a table for storing the musical sound name of a key-specified note being produced. For example, in the key-specified note producing table T2, the musical sound names of key-specified notes are stored starting with the first sounding note (note 1), as shown in FIG. 3

The difference tone producing table T3 is a table for storing the musical sound name of a difference tone corresponding to the key-specified note being produced, that is, the musical sound name of a difference tone being produced. For example, as shown in FIG. 4, the difference tone producing table T3 stores the musical sound name of a difference tone being produced and two key-specified notes corresponding to the difference tone in association with each other.

The ROM 14 is a memory for storing a difference tone identifying table T4 for identifying a difference tone perceived from two key-specified notes and various programs executed by the CPU 10. FIG. 5 shows the difference tone identifying table T4.

The difference tone identifying table T4 is a table for storing two key-specified notes (note A, note B) whose difference tone is perceived, a musical sound name of the difference tone and a volume factor in association with each other. As shown in FIG. 5, in this embodiment, a combination of certain musical sounds in harmonic relationship is described as a combination of two key-specified notes whose difference tone is perceived. In particular, musical sounds whose intervals are in the relationship of perfect fifth, perfect fourth, major third and minor third are described.

This is because the perception level is higher in the case where two harmonics for an arbitrary keynote are produced simultaneously than in the case where two sounds not in the harmonics relationship.

The volume factor described in the difference tone identifying table T4 is a multiplication factor of L0 used to calculate the perception level L0 of a difference tone produced by two key-specified notes corresponding to the volume factor used in case it is assumed that the perception level of a difference tone obtained when the second harmonic and the third harmonic are simultaneously produces is L0.

In particular, in this embodiment, assuming the velocity of a difference tone as L1, the volume levels of the two musical sounds (note A, note B) to cause the difference tone to be perceived as LA, LB, and the volume factor as k, L1 is obtained by using the following expressions:

$$L0[dB]=LA[dB]+LB[dB]-dL[dB] \quad (1)$$

$$L1[dB]=k\times L0[dB] \quad (2)$$

where dL is 120[dB] or 130[dB].

In this embodiment, the perception level L1 thus calculated is employed as a velocity of a difference tone to be produced.

In this embodiment, as shown in FIG. 5, the value of volume factor k is 1 for a second and a third harmonics (two sounds of perfect fifth), 0.9 for a third and a fourth harmonics (two sounds of perfect fourth), 0.8 for a fourth and a fifth harmonics (two sounds of major third), and 0.7 for a fifth and a sixth harmonics (minor third). This is because the higher-order the harmonic is, the lower the perception level of the difference tone gradually becomes according to the experiments by the inventors. Thus, in this embodiment, the strength of a difference tone can be set to approximately the same level as the actual perception level. Note that these calculation expressions and volume factor values are exemplary and more accurate calculation expressions and volume factor values may be employed, if any.

The sound source unit 15 is a unit which generates and outputs a sound signal according to the MIDI data supplied from the CPU 10. In this embodiment, the CPU 10 stores the performance event of a key-specified note and the performance event of a difference tone in predetermined separate track blocks in the MIDI data, which the CPU 10 supplies to the sound source unit 15. In response to this, the sound source unit 15 determines whether the performance event is a performance event of a key-specified note or a performance event of a difference tone based on the track block which contains the performance event.

Further, the CPU stores a reverberation-specifying event to specify the reverberation factor to be added to the difference tone of the MIDI data, to a track block assigned to the difference tone. In such a configuration, the sound source unit 15 also acts as an effect section to add a reverberation sound to a difference tone based on a reverberation-specifying event. As mentioned later, the sound source unit 15 according to this embodiment adds a reverberation sound to a key-specified note as default setting.

As shown in FIG. 1, the sound source unit 15 is constituted by a sound source section 20 and an effect section 21. The sound source section 20 generates a sound signal depending on the performance event in each track block of MIDI data. In particular, in case of performance event specified by a note-on event, the sound source section 20 generates a sound signal corresponding to the musical sound name (note number) and velocity specified by a note-on event, and in the case of performance event specified by a note-off event, it stops generating a sound signal of a musical sound name specified by a note-off event.

The effect section 21 includes a memory (not shown) for storing a plurality of reverberation factors to add the reverberation sound of a stone building and a convolution operation section (not shown) to perform convolution operation of these reverberation factors onto a sound signal.

The reverberation factors stored in the memory of the effect section 21 will be described. First, FIG. 6 shows the analysis result of the perception level L0 of a difference tone obtained when a second harmonic (2f0) and a third harmonic (3f0) are produced in a stone building.

In the memory of the effect section 21 are stored a reverberation factor ks1 for reproducing the reverberation characteristic C1 (see FIG. 6) of a second harmonic and third harmonic key-specified note and a reverberation factor ks2A for reproducing a reverberation characteristic C2A (see FIG. 6) from key-off event of one of the two key-specified notes comprising a second and a third harmonics to a key-off event of the both key-specified notes, and a reverberation factor ks2B for reproducing a reverberation characteristic C2B (see FIG. 6) after the key-off event of the both key-specified notes.

The effect section 21 performs convolution operation of the reverberation factor ks1 and outputs the resulting signal for a sound signal of a key-specified note among the sound signals corresponding to the tracks generated by the sound source section 20. The effect section 21 performs convolution operation of the reverberation factor ks2A or ks2B depending on the reverberation-specifying event and outputs the resulting signal for a sound signal of a difference tone. The effect section 21 compounds these reverberation sounds with a sound signal and outputs the resulting signal. In fact, the sound signal output from a convolution operation section is a digital signal so that the sound source unit 15 performs digital-to-analog conversion before outputting the resulting signal.

Figure 6:
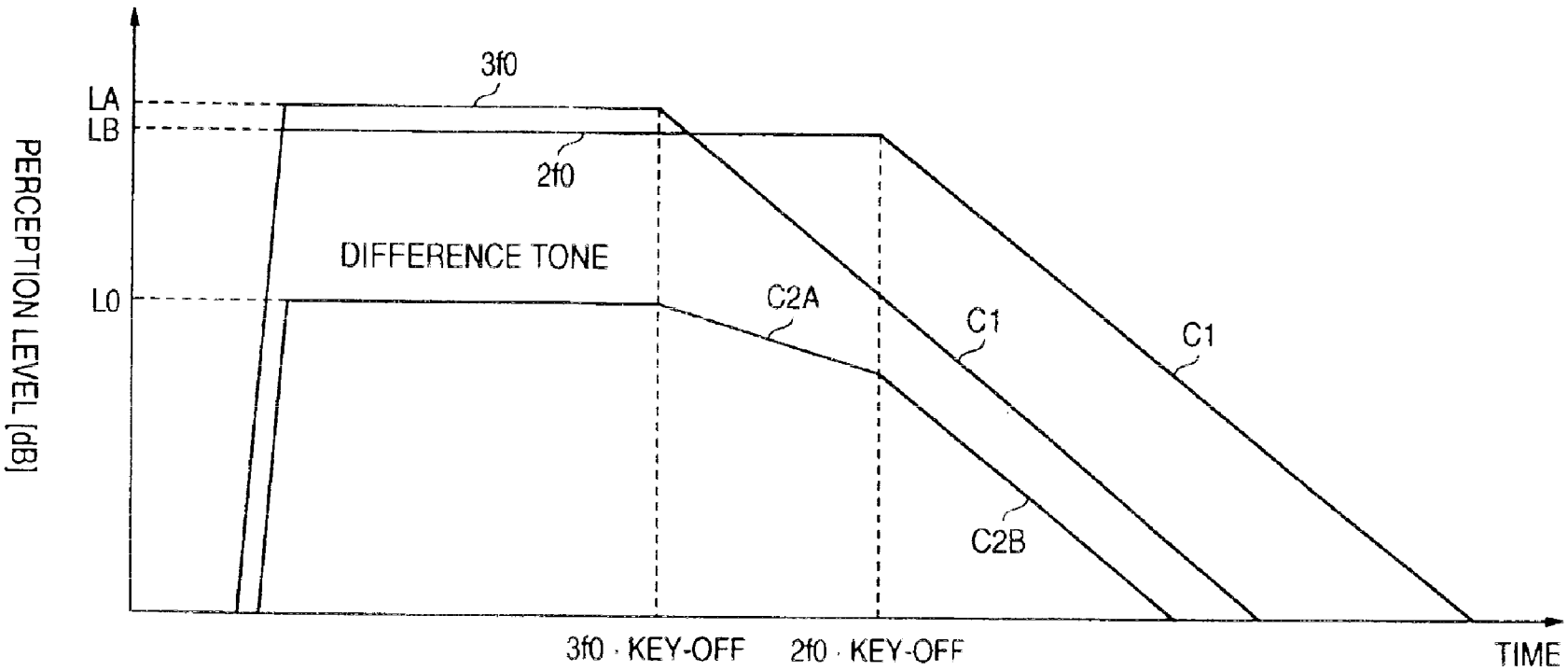
FIG. 6 shows the analysis result of the perception level L0 of a difference tone obtained when the second harmonic (2f0) and the third harmonic (3f0) are produces in a stone building.

As shown in FIG. 6, the reverberation characteristic C1 and the reverberation characteristic C2B are almost the same so that a single reverberation factor may be shared by the reverberation characteristic C1 and the reverberation characteristic C2B. As shown in FIG. 6, a difference tone is perceived with a predetermined delay time so that the timing of producing a difference tone is preferably delayed by that delay time from the timing of producing a key-specified note. While the effect section 21 adds only the reverberation sound in a stone building in this example for simplicity, the reverberation factors of other sound spaces may be stored in a memory and the reverberation sound of either sound space may be added based on the selection of the user, or alternatively, other effect features may be equipped.

The amplifier 16 amplifies the sound signal output from the sound source unit 15 and sounds the performance sound via the speaker 17. The speaker 17 may be a 2-channel speaker system comprising two speaker units arranged on the right and left, or a 4-channel speaker system.

(1.2) Operation of the First Embodiment

Figure 7:
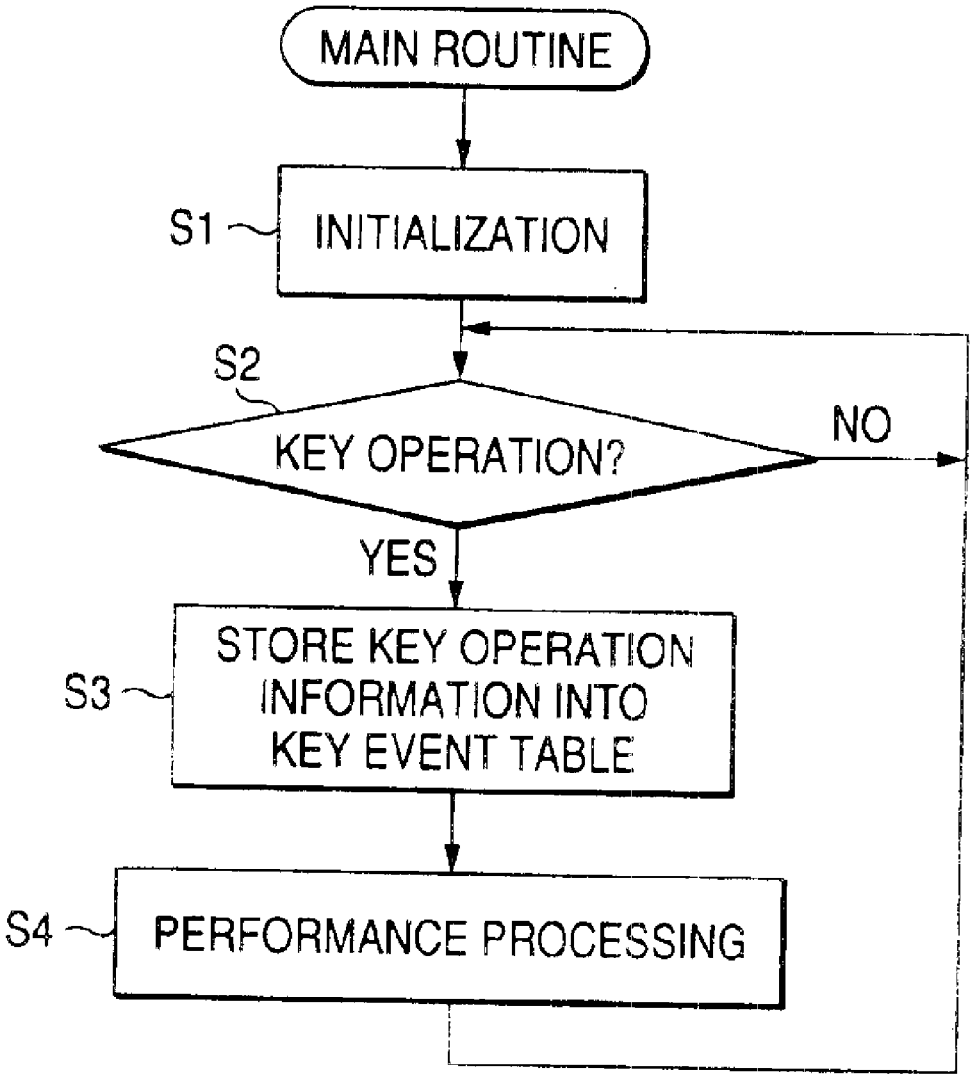
FIG. 7 shows a flowchart of the main routine.

In the electronic organ 1, when the power switch of the operating section 11 is operated and power is turned on, the CPU 19 executes a program stored in the ROM 14 to perform the following processing. FIG. 7 is a flowchart showing the main routine executed by the CPU 10.

The CPU 10 performs initialization when the power is turned on (step S1). In the step S1, the CPU 10 performs initialization of the RAM 13, initialization of the sensor of the key-on detecting section 12, and initial setting of the sound source unit 15. The key-on detecting section 12, on completion of initialization, detects the key operation (key-on and key-off event) in a predetermined cycle. The CPU 10 determines whether a key operation is detected on the key-on detecting section 12 in a predetermined cycle (step S2).

In case the determination result of step S2 is "NO," the CPU 10 repeats the determination. When a key operation is detected, the determination result of step S2 becomes "YES" and the processing by the CPU 10 proceeds to step S3. In step S3, the CPU 10 stores the key operation information into the key event table T1. When this processing is complete, the processing by the CPU 10 proceeds to step S4 to start performance processing. The performance processing is processing for sounding a performance sound corresponding to the key operation detected by the key-on detecting section 12. The CPU 10, on completion of the performance processing of step S4, proceeds to step S2. In this way, the CPU 10 repeats steps S2, S3 and S4 to control sounding the performance sound according to the performance of the performer.

Figure 8:
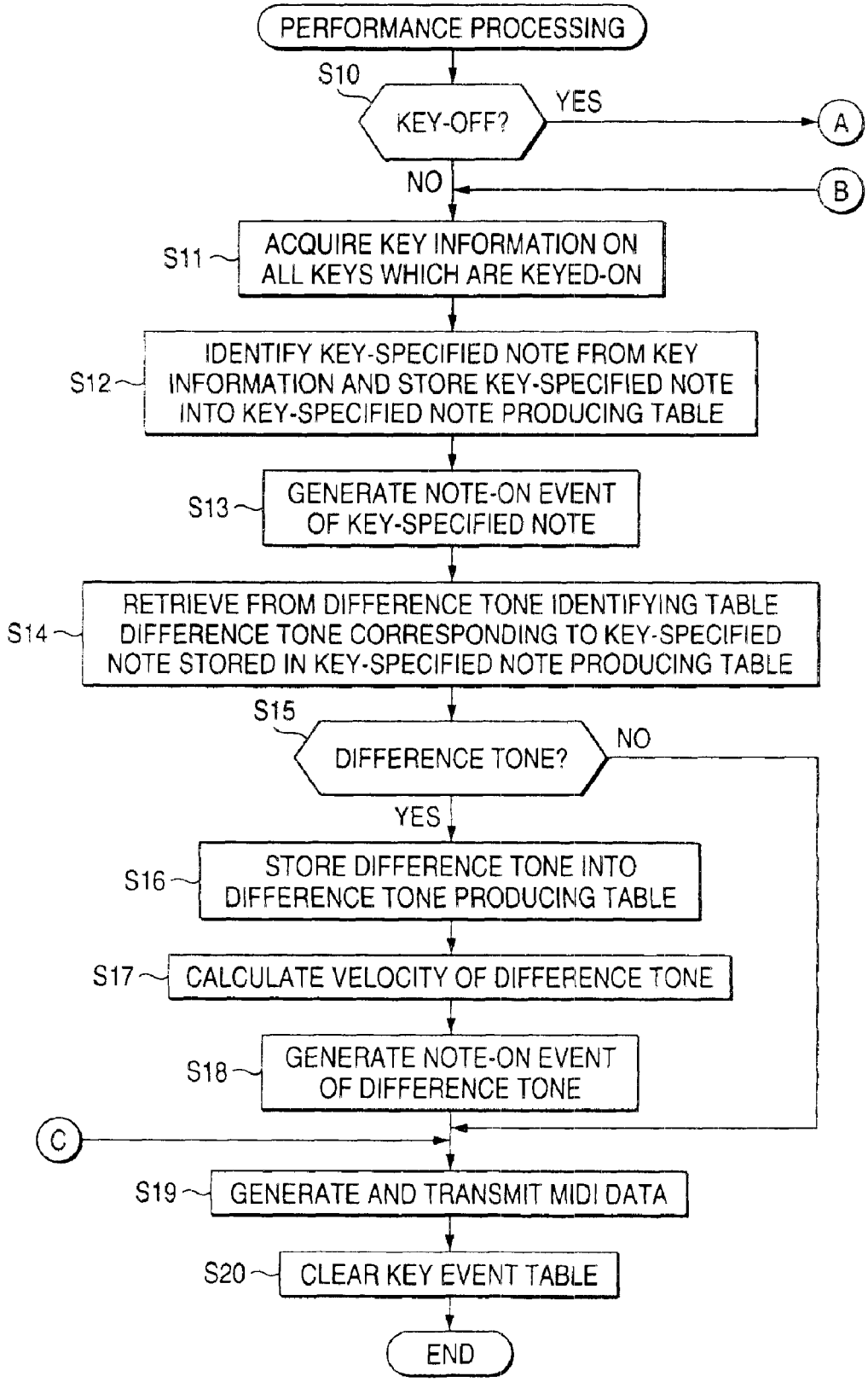
FIG. 8 shows a flowchart of a processing routine of performance processing.
Figure 9:
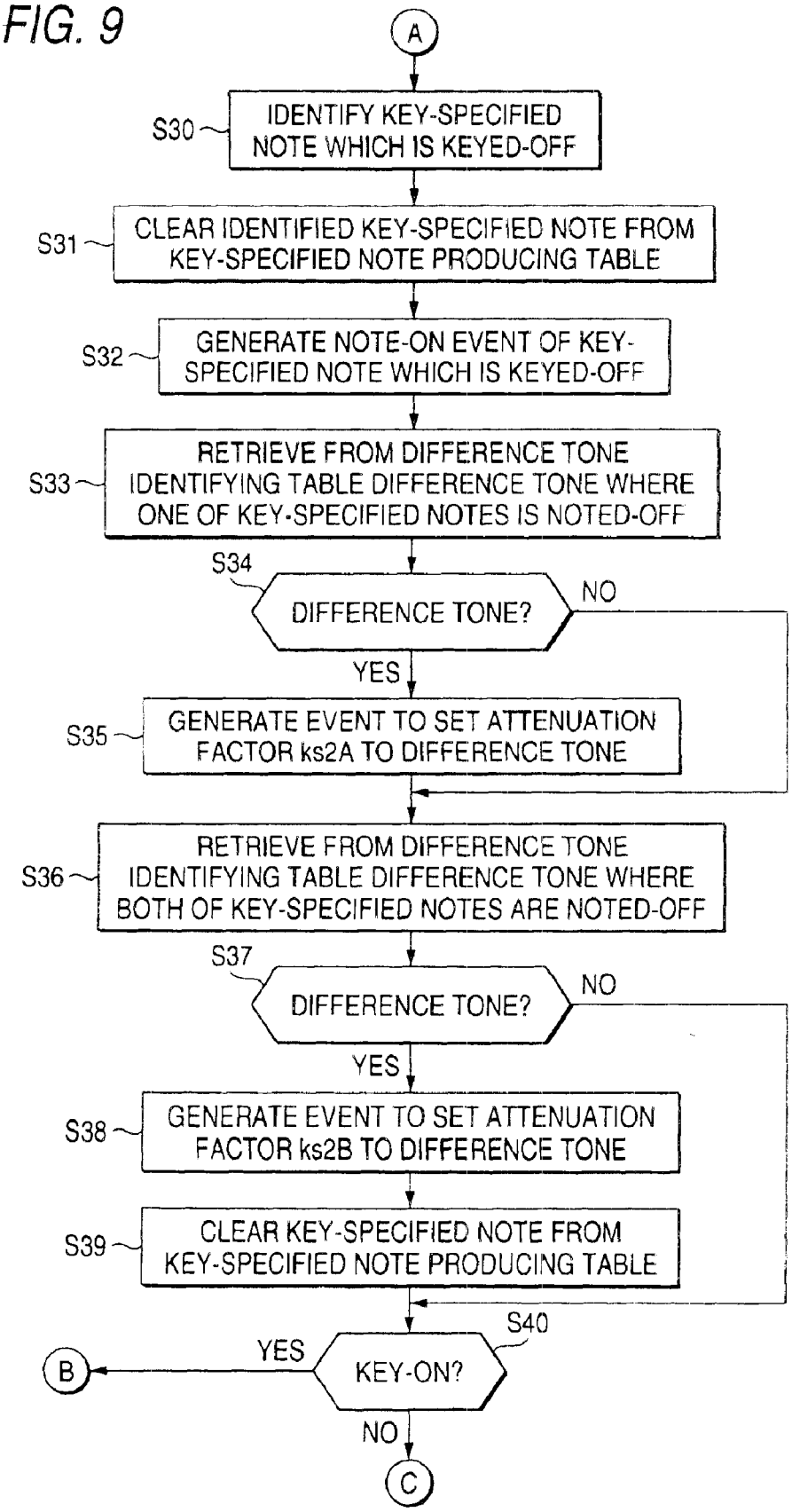
FIG. 9 is a subsequent flowchart of FIG. 8.

FIGS. 8 and 9 are flowcharts showing the processing routine of the performance processing.

The CPU 10 determines whether a key-off event is detected on the key-on detecting section 12 (step S10). In case the result of this determination is "NO," the CPU 10 acquires the key information and velocity stored in the key event table T1 of the RAM 13 (step S11), identifies the musical sound name of a key-specified note corresponding to each key which is keyed on, based on the acquired key information, and stores the musical sound name into the key-specified note producing table T2 (step S12). On completion of this processing, the CPU 10 generates a note-on event of a key-specified note corresponding to each key which is keyed on, and stores the event into the RAM 13 (step S13).

Next, the CPU 10 refers the difference tone identifying table T4 stored in the ROM 14 to retrieve a difference tone corresponding to two sounds for all combinations of two key-specified notes stored in the key-specified note producing table T2 (step S14). On completion of retrieval processing of step S14, the CPU 10 determines whether the difference tone is extracted or not (step S15).

In case the determination result of step S15 is "NO," the processing by the CPU 10 proceeds to step S19 and generates MIDI data where a note-on event of a key-specified note generated in step S13 is stored into a predetermined track block, and transmits the MIDI data to the sound source unit 15.

In case any difference tone satisfying the aforementioned condition is extracted in the retrieval processing of step S14, the determination result of step S15 becomes "YES" and the processing by the CPU 10 proceeds to step S16.

In step S16, the CPU 10 acquires the musical sound names of the two key-specified notes corresponding to the extracted difference tones from the difference tone identifying table T4 stored in the ROM 14, and stores the musical sound names into the difference tone producing table T3.

On completion of this processing, the processing by the CPU 10 proceeds to step S17. The CPU 10 acquires the volume factor of each difference tone extracted from the difference tone identifying table T4 while acquiring the velocity of the two key-specified notes corresponding to each difference tone from the key event table T1, then performs the operation processing of the expressions (1) and (2) to calculate the velocity of each difference tone.

On completion of the operation processing of step S17, the processing by the CPU 10 proceeds to step S18 and generates a note-on event of a difference tone and stores the event into the RAM 13, then the processing by the CPU 10 proceeds to step S19.

In step S19, CPU 10 generates MIDI data where a note-on event of a difference tone generated in step S18 and a note-on event of a key-specified note generated in step S13 are stored into predetermined track blocks, and supplies the MIDI data to the sound source unit 15.

On completion of the processing of step S19, the processing by the CPU 10 proceeds to step S20 where the CPU 10 clears the key event table T1 and terminates the performance processing.

In the determination of step S10, in case the key-on detecting section 12 has detected any key-off event, the determination result of step S10 becomes "YES" and the processing by the CPU 10 proceeds to step S30.

In step S30, the CPU 10 identifies the musical sound name of a key-specified note corresponding to each key which is keyed off, based on the storage information of the key event table T1.

Next, the processing by the CPU 10 proceeds to step S31, where the CPU 10 clears the musical sound name (key-specified note) of a key which is keyed off from the key-specified note producing table T2. Then the processing by the CPU 10 proceeds to step S32, where the CPU 10 generates a note-off event of an identified key-specified note, and stores the event into the RAM 13.

On completion of step S32, the processing by the CPU 10 proceeds to step S33, where the CPU 10 retrieves a difference tone stored in the difference tone producing table T3 where a note-off event of a key-specified note identified in step S30 causes a note-off event of one of the two key-specified notes corresponding to the difference tone. In particular, the CPU 10 retrieves a key-specified note paired with a key-specified note identified in step S30 from the key-specified notes stored in the difference tone producing table T3 and retrieves a difference tone corresponding to the identified key-specified note which is stored in the key-specified note producing table T2.

On completion of the retrieval processing of step S33, the processing by the CPU 10 proceeds to step S33, where the CPU 10 determines whether a difference tone satisfying the aforementioned condition is extracted.

In case any difference tone satisfying the aforementioned condition is extracted in the determination of step S34, the determination result of step S34 becomes "YES" and the processing by the CPU 10 proceeds to step S35. In step S35, the CPU 10 generates a reverberation-specifying event to set an attenuation factor ks2A and stores the event into the RAM 13. The processing by the CPU 10 proceeds to step S36.

In case the determination result of step S34 is "NO," the processing by the CPU 10 skips step S35 and proceeds to step S36.

In step S36, the CPU 10 retrieves a difference tone stored in the difference tone producing table T3 where a note-off event of a key-specified note identified in step S30 causes a note-off event of both of the two key-specified notes corresponding to the difference tone. This processing may be a retrieval of a difference tone where a key-specified note paired with the key-specified note to note-off identified in the difference tone producing table T3 in step S33 is not stored in the key-specified note producing table T2.

On completion of the retrieval processing of step S36, the processing by the CPU 10 proceeds to step S37, where the CPU 10 determines whether a difference tone where both of the two key-specified notes corresponding to the difference tone will undergo a note-off event.

In case any difference tone satisfying the aforementioned condition is extracted in the determination of step S37, the determination result of step S37 becomes "YES" and the processing by the CPU 10 proceeds to step S38. In step S38, the CPU 10 generates a reverberation-specifying event to set an attenuation factor ks2B and stores the event into the RAM 13. The processing by the CPU 10 proceeds to step S39, where the CPU 10 clears the difference tone from the difference tone producing table T3.

On completion of the processing of step S39, or in case the determination result of step S37 is "NO," the processing by the CPU 10 proceeds to step S40.

In step S40, the CPU 10 determines whether a key-on event is detected by the key-on detecting section 12. In case the determination result of step S40 is "YES," the processing by the CPU 10 proceeds to step S11, where the CPU 10 generates note-on events of key-specified notes and difference tones in steps S11 through S18.

In case the determination result of step S40 is "NO," the processing by the CPU 10 proceeds to step S19, where the CPU 10 generates MIDI data where various events generated in steps S32, S35 and S38 are stored in predetermined track blocks, and transmits the MIDI data to the sound source unit 15. On completion of the transmission processing, the processing by the CPU 10 proceeds to step S20. In step S20, the CPU 10 clears the key event table T1 to terminate the performance processing.

In this way, for the electronic organ 1, the CPU 10 registers the key-specified note which was keyed on in step S12 with a key-specified note producing table T2. In step S14, the CPU 10 references the difference tone identifying table T4 based on the key-specified note registered with the key-specified note producing table T2 and identifies the difference tone. It is thus possible to correctly identify the difference tone perceived from any two sounds of the newly key-specified notes which are keyed-on and the key-specified notes being produced.

The electronic organ 1 can sound performance sounds corresponding to a key-specified note which is keyed-on and the identified difference tone by generating, on the CPU 10, MIDI data containing a note event of the key-specified note which is keyed-on and a note event of the identified difference tone and supplying the MIDI data in step S19.

The CPU 10 sets the velocity of the difference tone to the approximately same value as the actual perception level based on the velocity of two sounds to cause the difference tone to be perceived and the volume factor in step S17. Thus, the electronic organ 1 can sound a natural difference tone even in a dry structure acoustic space where the difference tone used to be difficult to perceive due to a different sound absorption characteristic or in an outdoor environment.

In the electronic organ 1, in case a key-off event is detected, the CPU 10 retrieves a difference tone where a note-off event of a key-specified note keyed-off among those stored in the difference tone producing table T3 causes a note-off event of one of the two key-specified notes to cause the corresponding difference tone to be perceived in step S33. For the difference tone, the CPU 10 generates a reverberation-specifying event to set an reverberation factor ks2A for reproducing the reverberation characteristic C2A (see FIG. 5) of a stone building obtained in case one of the two sounds to cause the difference tone to be perceived is keyed-off and the MIDI data containing the event, then supplies the MIDI data to the sound source unit 15 in step S35.

In the electronic organ 1, the CPU 10 retrieves a difference tone where a note-off event of a key-specified note keyed-off among those stored in the difference tone producing table T3 causes a note-off event of both of the two key-specified notes to cause the corresponding difference tone to be perceived in step S36. For the difference tone, the CPU 10 generates a reverberation-specifying event to set an reverberation factor ks2B for reproducing the reverberation characteristic C2B (see FIG. 5) of a stone building obtained in case both of the two sounds to cause the difference tone to be perceived are keyed-off and the MIDI data containing the event, then supplies the MID data to the sound source unit 15 in step S38.

As a result, the electronic organ 1 can vary the reverberation sound added to a difference tone, same as the reverberation sound of a difference tone perceived in an actual stone building, by switching over, on the sound source unit 15, a reverberation sound added to the difference tone in accordance with the reverberation-specifying event. While the note-off event of a difference tone is not mentioned, the sound source unit 15 may be previously set to note off a difference tone with a reverberation-specifying event to set the attenuation factor ks2B or the CPU 10 may describe a note-off event into a same track block as the reverberation-specifying event in the MIDI data.

In the electronic organ 1, the sound source unit 15 sounds a key-specified note with a reverberation sound added based o the reverberation factor ks1 for reproducing the reverberation characteristic C1 of the key-specified note obtained when the key-specified note is produced in a stone building.

With this configuration, the electronic organ 1 can sound the performance sounds reproducing the reverberation sound of a key-specified note, a difference tone and the reverberation sound of the difference tone in a stone building as well as reproduce an acoustic space of a stone building even in a dry structure acoustic space and an outdoor environment.

As understood from the foregoing description, it is possible to sound a difference tone previously perceived by the auditory system as included in a performance sound, by using the electronic organ 1 according to this embodiment. In other words, the electronic organ 1 can reinforce the difference tone heard from a performance sound. As a result, the electronic organ 1 can sound a performance sound with a "rich bass" lower than the actual performance sound in an arbitrary acoustic space such as a dry structure acoustic space, thereby reproducing an acoustic space of a stone building.

(2) Second Embodiment

Figure 10:
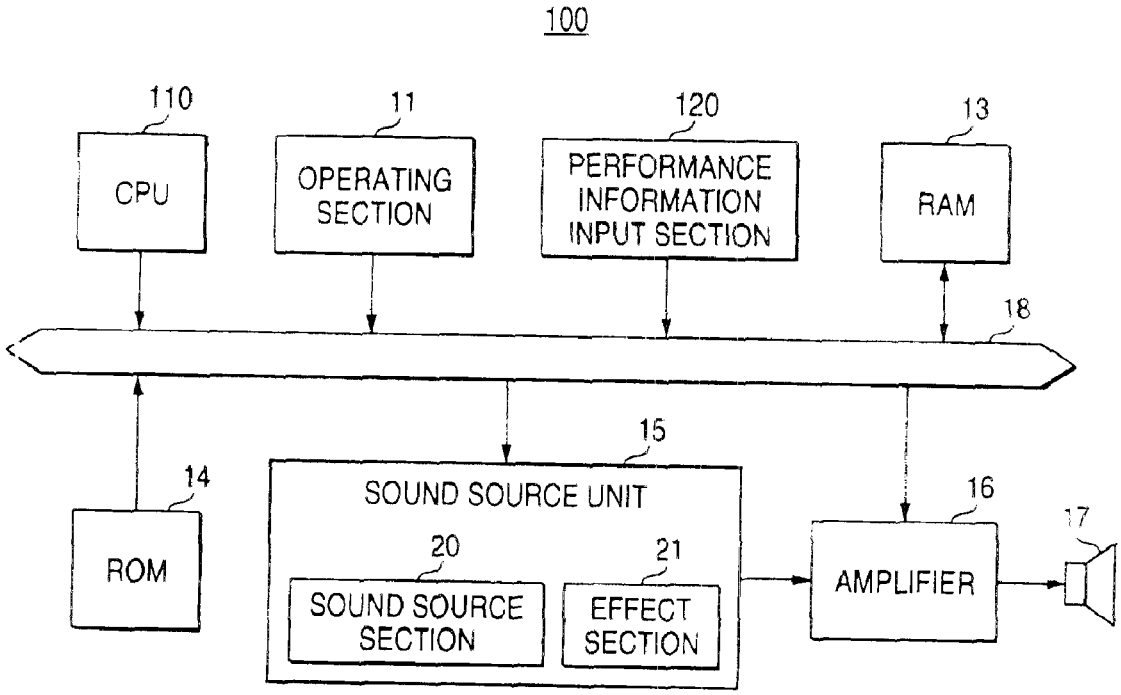
FIG. 10 is a block diagram of an electric configuration of difference tone output apparatus 100 according to a second embodiment.

FIG. 10 is a block diagram of an electric configuration of difference tone output apparatus 100 according to a second embodiment.

The difference tone output apparatus 100 differs from the electronic organ 1 according to the first embodiment in that the difference tone output apparatus 100 comprises a performance information input section 120 for inputting performance information such as MIDI data from the exterior instead of the key-on detecting section 12 and that a CPU 110 carries out the performance processing based on the performance information input from the key-on detecting section 12. The same configuration as the electronic organ 1 according to the first embodiment is given the same numeral and the detailed description is omitted.

In the difference tone output apparatus 100, a performance information input section 120 conforms to MIDI interface specifications and receives MIDI data from performance information output apparatus connected via a communications cable under control by the CPU 110. The performance information output apparatus is for example MIDI equipment such as a MIDI keyboard and a computer capable of outputting MIDI data.

The CPU 100 performs key operation detection processing (step S2), storage processing of the key event table T1 (step S3), and performance processing (step S4) according to the first embodiment, based on a performance event of the MIDI data received via the performance information input section 120. The key event table T1 stores note numbers and velocity in the performance event.

Performance processing carried out by the CPU 110 which differs from that in the first embodiment will be described.

The CPU 110 detects a key-off event in step S10 by detecting a note-off event in the MIDI data received.

The CPU 110 stores a key-specified note being produced in the key-specified note producing table T2 in steps S11 and S12 based on a note-on event in the MIDI data. The processing to generate a note event of a key-specified note in step S13 is not necessary since note events already described in the received MIDI data are available.

Similarly, the processing in steps S30 through S31 may be performed by the CPU 110 based on a note-off event in the received MIDI data and the note-off event generation processing in step S32 has already been described in the received MIDI data so that it is not necessary.

The CPU 110, after executing the difference tone identifying processing and difference tone note event processing in steps S14 through S18, or after the reverberation-specifying event generating processing in steps S33 through S39, generates MIDI data based on various events of the generated difference tone and a performance event in the received MIDI data, and transmits the MIDI data to the sound source unit 15.

The difference tone output apparatus 100 according to the second embodiment converts the received MIDI data to MIDI data containing a performance event of a difference tone and a reverberation-specifying event and supplies the resulting MIDI data to the sound source unit 15.

With this configuration, the difference tone output apparatus 100 can sound a performance sound containing a difference tone not included in the MIDI data input from the exterior, based on the MIDI data.

As understood from the foregoing description, it is possible to sound a performance sound with a "rich bass" heard in a stone building with the related art MIDI data, by using the difference tone output apparatus 100.

(2.1) Variations of the Second Embodiment

While MIDI data is received as performance information in this embodiment, a sound signal itself may be input. BY converting an input sound signal to MIDI data through a related art method, it is possible to generate a sound signal comprising the sound signal plus difference tone. The sound signal may be input via communications apparatus such as a modem or TA (Terminal Adapter), or by way of an external voice via a microphone.

In this embodiment, the difference tone output apparatus 100 has been described for sounding a performance sound including a performance sound corresponding to the input performance information plus difference tone based on the input performance information. The invention is not limited to this example but may sound a difference tone alone based on the input performance information.

With this configuration, the difference tone output apparatus 100 may be applied to a sound field support system used to improve a sound field such as a hall as well as a so-called sound source unit or a tone generator, by connecting to a performance unit such as a MIDI keyboard without a sound source.

(3) Variations

The invention may be implemented in various aspects as well as the foregoing embodiments. For example, the following variations are possible.

(3.1)

In the foregoing embodiments, the cases where a difference tone is produced based on musical sounds in the relationship of perfect fifth, perfect fourth, major third and minor third are described. The invention is not limited to these cases but all the difference tones (musical sounds of number of vibrations corresponding to the difference between the vibrations of the key-specified notes) may be always produces in case the key-specified notes are simultaneously produced.

(3.2)

In the foregoing embodiments, the perception level L0 of the difference tone obtained using Expression (1) is multiplied by the volume factor k and the value obtained is assumed as the velocity L0 of the difference tone. The invention is not limited to this configuration but the perception level obtained from Expression (1) may be used as the velocity of the difference tone without using the volume factor k. This is because the volume of a difference tone is perceived in a considerably lower volume than that of a key-specified note so that a sufficient effect is obtained without strict calculation of velocity. In this case, it is not necessary to store the volume factor k into the difference tone identifying table thus reducing the necessary data amount and eliminates the need for processing to extract the volume factor k for arithmetic operation. This reduces the processing load of the CPUs 10, 110.

(3.3)

While the effect processing where the sound source unit 15 adds a reverberation sound based on predetermined reverberation factors ks1, ks2A, ks2B in the foregoing embodiments, the user may change the setting of a rise time, sustaining tone level, attenuation time 1 (corresponding to attenuation characteristic C2A), and attenuation time 2 (attenuation characteristic C2B).

(3.4)

While the an electronic musical instrument of the invention is an electronic organ in the first embodiment, the invention is applicable to a variety of electronic musical instruments such as a keyboard instrument including an electronic piano and a string instrument such as an electronic violin. The invention is also applicable to a computer equipped with a performance feature such as a PC equipped with a software sound source or hardware sound source, and a tone generator. The difference tone output apparatus 100 according to the second embodiment is preferable for sounding the performance sound or difference tone of a musical instrument having a difference tone which has been readily perceived by the performer, such as a pipe organ, piano, base, or violin.

(3.5)

While the programs to execute a main routine shown in FIG. 7 or a performance processing routine shown in FIGS. 8 and 9 are previously stored in the electronic organ 1 or difference tone output apparatus 100, the invention is not limited to this embodiment but a configuration is possible where this program is stored onto a computer-readable recording medium such as a magnetic recording medium, an optical recording medium, and a semiconductor storage medium so that the computer will read and execute the program. The program may be stored into a server and the server may transmit the program to a requesting terminal such as a PC via a network.

As mentioned earlier, according to the invention, it is possible to reproduce a performance sound with a "rich bass" heard in a stone building.

What is claimed is:

1. An electronic musical instrument comprising:

a plurality of operating members for performance, a detector which detects operation of the operating members, a signal generator which generates a sound signal of a musical sound assigned to each of the operating members according to the detection result of the detector, wherein in the case of generating a sound signal to simultaneously produce musical sounds of different pitches assigned to the operating members, the signal generator generates the sound signal of the musical sounds of different pitches and a musical sound equivalent to a difference tone perceived from the musical sounds of different pitches; and an output unit which outputs a sound signal generated by the signal generator.

2. An electronic musical instrument according to claim 1, wherein the signal generator, in the case of generating a sound signal where one of the musical sounds of different pitches is silenced after generating a sound signal of musical sounds of different pitches and a musical sound equivalent to a difference tone perceived from the musical sounds of different pitches, generates a sound signal except the musical sound to be silenced and the difference tone corresponding to the musical sound.

3. An electronic musical instrument according to claim 1, wherein a difference tone perceived from the musical sounds of different pitches are musical sounds having the number of vibrations corresponding to the difference between the vibrations of the musical sounds of different pitches.

4. An electronic musical instrument according to claim 1, wherein the signal generator includes:

a storage unit which stores a difference tone identifying table associating sounds of different pitches with a difference tone perceived from the sounds of different pitches, a retrieval unit which retrieves a difference tone corresponding to the musical sounds of different pitches from the difference tone identifying table, in the case of generating a sound signal which causes the musical sounds of different pitches to be simultaneously produced, and a sound source unit which generates a sound signal corresponding to the difference tone and the musical sounds of different pitches in case the difference tone is extracted by the retrieval unit, and generates a sound signal corresponding to the musical sounds of different pitches in case the difference tone is not extracted by the retrieval unit.

5. An electronic musical instrument according to claim 4, wherein the retrieval unit, after a sound signal corresponding to the difference tone and the musical sounds of different pitches is generated, retrieves a difference tone corresponding to a musical sound to be silenced from the difference tone identifying table in case a sound signal where one of the musical sounds of different pitches is silenced is to be generated, and the sound source unit generates a sound signal except the difference tone and the musical sound to be silenced in case the difference tone is extracted by the retrieval unit, and generates a sound signal where the musical sound to be silenced is eliminated in case the difference tone is not extracted by the retrieval unit.

6. The electronic musical instrument according to claim 4, wherein the sound source unit includes an effect unit which generates a sound signal where reverberation sounds are added to the musical sounds and a difference tone which are produced simultaneously.

7. An electronic musical instrument according to claim 4, wherein the effect unit switches over a reverberation sound to be added to the difference tone between the case where one of the musical sounds corresponding to the difference tone in the difference tone identifying table is silenced and the case where both of the musical sounds are silenced.

8. A difference tone output apparatus comprising:

an input unit which inputs performance information to specify a musical sound;

a signal generator which generates a sound signal based on the musical sound specified by the performance information, wherein the signal generator generates a sound signal of musical sounds of different pitches and a musical sound equivalent to a difference tone perceived from the musical sounds of different pitches in case the performance information has instructed simultaneous production of the musical sounds of different pitches; and an output unit which outputs a sound signal generated by the signal generator.

9. A difference tone output apparatus comprising:

an input unit which inputs performance information to specify a musical sound;

a signal generator which generates a sound signal based on the musical sound specified by the performance information, wherein the signal generator generates a sound signal of a musical sound equivalent to a difference tone perceived from musical sounds of different pitches in case the performance information has instructed simultaneous production of the musical sounds of different pitches; and an output unit which outputs a sound signal generated by the signal generator.

10. A computer readable recording medium storing program for causing a computer comprising a plurality of operating members and a detector for detecting the operation of the operating members to work as:

a signal generator which generates a sound signal based on the musical sound specified by the performance information, wherein the signal generator generates a sound signal of musical sounds of different pitches and a musical sound equivalent to a difference tone perceived from the musical sounds of different pitches in case the performance information has instructed simultaneous production of the musical sounds of different pitches, and an output unit which outputs a sound signal generated by the signal generator.

11. A computer readable recording medium storing a program for causing a computer to work as:

a signal generator which generating a sound signal based on the musical sound specified by the performance information, wherein the signal generator generates a sound signal corresponding to a musical sound equivalent to a difference tone perceived from the musical sounds of different pitches in case the performance information has instructed simultaneous production of the musical sounds of different pitches, and an output unit which outputs a sound signal generated by the signal generator.

* * * * *